US011744335B2

(12) United States Patent
Yao

(10) Patent No.: US 11,744,335 B2
(45) Date of Patent: Sep. 5, 2023

(54) RING ACCESSORY, A RING HEAD STRUCTURE AND A RING

(71) Applicant: Shenzhen Aimeng Technology Co., Ltd., Shenzhen (CN)

(72) Inventor: Huabin Yao, Shenzhen (CN)

(73) Assignee: Shenzhen Aimeng Technology, LTD, Shenzhen (CN)

( * ) Notice: Subject to any disclaimer, the term of this patent is extended or adjusted under 35 U.S.C. 154(b) by 650 days.

(21) Appl. No.: 16/096,182

(22) PCT Filed: Oct. 11, 2017

(86) PCT No.: PCT/CN2017/105757
§ 371 (c)(1),
(2) Date: May 12, 2021

(87) PCT Pub. No.: WO2019/019415
PCT Pub. Date: Jan. 31, 2019

(65) Prior Publication Data

US 2021/0315332 A1 Oct. 14, 2021

(30) Foreign Application Priority Data

Jul. 27, 2017 (CN) ..... 201710624641.8
Jul. 27, 2017 (CN) ..... 201720921689.0

(51) Int. Cl.
*A44C 9/00* (2006.01)
*A44C 17/02* (2006.01)
*A44C 25/00* (2006.01)

(52) U.S. Cl.
CPC ..... *A44C 9/0084* (2013.01); *A44C 17/0208* (2013.01)

(58) Field of Classification Search
CPC ..... A44C 9/0084; A44C 17/0208; A44C 17/0216; A44C 17/0225; A44C 25/00; A44C 25/007; A44C 9/00; A44C 9/0053
See application file for complete search history.

(56) References Cited

U.S. PATENT DOCUMENTS 1,574,962 A * 3/1926 Fischer ..... A44C 9/00 63/3
2,119,039 A * 5/1938 Boyd ..... A44C 9/00 63/29.1
11,330,875 B1 * 5/2022 Roeder ..... A44C 5/0007

FOREIGN PATENT DOCUMENTS

CN 201657879 U 12/2010
CN 203435802 U 2/2014
(Continued)

OTHER PUBLICATIONS

International Search report dated Apr. 25, 2018 for related PCT Application No. PCT/CN2017/105757 attached.

*Primary Examiner* — Jack W Lavinder
(74) *Attorney, Agent, or Firm* — Robert L. Stearns; Dickinson Wright PLLC

(57) ABSTRACT

A ring accessory comprises an outer loop and an elastic piece placed in the outer loop. The outer loop comprises a lateral loop and a top cover located above the lateral loop. The top cover has a hole for a ring head passing through. An inner side of the top cover at an edge of the hole comprises at least three deep recesses, and a shallow recess between every two adjacent deep recesses. A distance from the deep recess to hole center is greater than a distance from the shallow recess to the hole center. The elastic piece has recesses corresponding to the deep recesses and shallow recesses on the top cover. The elastic piece is an annulus with a wave shape, the elastic piece deep recesses are
(Continued)

located at the bottom of the wave, and the elastic piece shallow recesses are located at the top of the wave.

10 Claims, 6 Drawing Sheets

(56) References Cited

FOREIGN PATENT DOCUMENTS

| | | | |
|---|---|---|---|
| CN | 203897487 | U | 10/2014 |
| CN | 203952647 | U | 11/2014 |
| CN | 204763779 | U | 11/2015 |
| CN | 205082808 | U | 3/2016 |
| CN | 205358503 | U | 7/2016 |
| CN | 107232702 | A | 10/2017 |
| JP | 2000093216 | A | 4/2000 |
| JP | 2002051811 | A | 2/2002 |

* cited by examiner

RING ACCESSORY, A RING HEAD STRUCTURE AND A RING

CROSS REFERENCE

The present application is a national phase application under 35 U.S.C. § 371 of International Patent Application No. PCT/CN2017/105757 filed Oct. 11, 2017, which application claims priority of Chinese Patent Application No. 201710624641.8, filed on Jul. 27, 2017, entitled "a ring accessory, a ring head structure and a ring", the entire contents of all of which are incorporated herein by reference for all purposes.

TECHNICAL FIELD

The present application relates to a finger ring, and more particularly to the technology of a ring head.

BACKGROUND

The existing finger ring includes a ring body and a ring support located at the ring body, and a gemstone is generally inlaid on the ring support. For a ring inlaid with diamond, due that the diamond is expensive, the natural particles are small, and the general diamond ring is not conspicuous enough, it is easy to be boring for a long time, and the decorative effect is not durable. In order to continuously enhance the attraction of the ring, in the prior art, technical situation of replacing the ring support has been proposed, that is, the ring support can be replaced, and if a ring head is aesthetically tired, the ring head can be replaced. However, if the ring head is diamond, it is a luxury because of the high price of the diamond, and is not suitable to be replaced according to the preference. Therefore, for a ring with a valuable inlay, the technique of replacing the ring head is not very suitable, and its application and promotion will be limited.

SUMMARY

A first technical problem of the present application needs to be solved is to provide a ring accessory, which can be fixed at the ring head and realize disassembly function.

A second technical problem of the present application needs to be solved is to provide a top structure of the ring, which can be used to fixedly connect other decorations and realize disassembly function.

A third technical problem of the present application needs to be solved is to provide a ring, the ring head thereof can be used to fixedly connect replaceable decorations.

In order to solve the first technical problem of the present application, the present application provides a ring accessory including: an outer loop and an elastic piece; the elastic piece is placed in the outer loop; the outer loop includes a lateral loop and a top cover located above the lateral loop; the top cover has a hole for a ring head passing therethrough, an inner side of the top cover at an edge of the hole includes at least three deep recesses, and a shallow recess is provided between every two adjacent deep recesses, wherein a distance from the deep recess to the center of the hole is greater than a distance from the shallow recess to the center of the hole; the elastic piece is annular and includes recesses, i.e., elastic piece deep recesses and elastic piece shallow recesses respectively corresponding to the deep recesses and the shallow recesses of the top cover, the elastic piece is an annulus with a wave shape, and the elastic piece deep recesses are located at the bottom of the wave, and the elastic piece shallow recesses are located at the top of the wave. The outer loop of the above structure can be covered on the ring head, and a surface of the outer loop can be inlaid with jewel particles as a decorative object of the inlay on the ring head. The outer loop can be freely replaced, and it is very convenient to install and remove from the ring head. The elastic piece in the outer loop can tightly clamp the ring head, so that the outer loop is not easy to loose and fall off. The outer loop provides a large surface that can be designed on thereof to make the ring head more decorative and the outer loop can be firmly fixed to the ring head. For a diamond ring, you can achieve a variety of diamond ring styles without changing a diamond head. The ring accessory of the present application can be perfectly fixed on the ring head, and is easy to disassemble and replace, which solve the problem that the ring head cannot be replaced at all in the prior art.

Preferably, there are four deep recesses on the inner side of the top cover, and four shallow recesses are respectively arranged between adjacent ones of the four deep recesses; the elastic piece also includes four elastic piece deep recesses and four elastic piece shallow recesses.

In one embodiment, a combination of three deep recesses and shallow recesses can be designed. Therefore, it is not limited to the design scheme of four deep recesses and four shallow recesses.

For the design scheme of four deep recesses and four shallow recesses, an octagonal pattern, four deep corners and four shallow corners are formed on the top cover. After a support rod of the ring support passes through the deep recess, it just rotates 45° into the shallow recess and is locked in the shallow recess by the elastic piece. The number of deep recesses and shallow recesses is matched with the number of support rods, so five or six support rods can be used, and the corresponding deep recesses and shallow recesses are also five or six. The ring support is fixed on the body of the finger ring.

Preferably, the deep recesses and the shallow recesses on the top cover are evenly distributed on the top cover; and an asymmetrical design may also be adopted.

Preferably, a bottom cover is further disposed under the lateral loop, and a bottom opening is disposed in the middle of the bottom cover for a ring head to pass through. The bottom cover is an optional component, and the bottom cover is provided to increase the strength of the outer loop and even serve as a support component for the elastic piece. In the case of having the bottom cover, the elastic piece not only receives squeezing support from the side cover, but also be supported from the bottom cover, so that the elastic piece is not easily dropped from the outer loop. However, the bottom cover should not be too wide and needs to be passed through by the support rod, in general, the width thereof is smaller than a distance from the deep recess to the side of the outer loop.

Preferably, a distance from the elastic piece shallow recess to the center of the hole is smaller than a distance from the shallow recess to the center of the hole. The elastic piece needs to apply force to the support rod in a radial direction. In the situation of the outer loop is not elastic, the diameter of the elastic piece is smaller than the hole diameter of the top cover, which is advantageous for the elastic piece to fasten the support rod, so that the outer loop is not easy to loosen.

Preferably, a pendant is further disposed below the outer loop. The pendant can used to shelter the bottom of the outer loop.

Preferably, the outer loop is circular, and the elastic piece is a rounded quadrangle. The elastic piece is a wavy component with a rounded quadrangle. After being pressed by the support rods on the four sides of the quadrilateral, the elastic piece expands outward and the whole tends to be circular to ensure that the elastic piece has sufficient expansion space in the outer loop, which not only ensures the elastic force of the elastic piece, but also ensures the expansion space thereof, the elastic piece is non-circular before the force is applied, and its diameter is small, which is easier to fit into the outer loop, and the disassembly is quicker and more convenient.

In order to solve the second technical problem of the present application, the present application provides a top structure of the ring, including: a ring accessory, the ring accessory includes an outer loop and a spring piece; the elastic piece is placed in the outer loop; the outer loop includes a lateral loop and a top cover located above the lateral loop; the top cover has a hole for a ring head to pass through, the inner side of the top cover and the edge of the hole includes at least three deep recesses, and a shallow recess disposed between adjacent two deep recesses, wherein a distance from the deep recess to the center of the hole is greater than a distance from the shallow recess to the center of the hole; the elastic piece is an annular elastic piece including recesses corresponding to the deep recesses and the shallow recesses on the top cover, That is, the elastic piece deep recesses and the elastic piece shallow recesses, the elastic piece is an annulus with a wave shape, the elastic piece deep recesses are located at the bottom of the wave, and the elastic piece shallow recesses are located at the top of the wave.

The top structure of the ring further includes a ring support, the ring support includes a support rod; the support rod includes a distal end located at an upper portion thereof, and a distance from the distal end to the symmetry center of the ring support is no greater than a distance from the deep recess to the center of the hole.

The ring support of the present application needs to be designed matching with the outer loop, and they need to be matched. The distal end of the support rod needs to pass through the deep recess so that the inlaid portion can be exposed from above the outer loop, therefore, the length of the distal end to the center line needs no greater than the length of the deep recess to the center line.

Preferably, the support rod further includes a proximal end located at a lower portion thereof, a distance from the proximal end to the symmetry center of the ring support is smaller than a distance from the distal end, and a distance from the proximal end to the center of the symmetric of the ring support is no greater than a distance from the shallow recess to the center of the hole, a transition portion configured between the distal end and the proximal end of the support rod; the outer loop is fixed on the ring support, the upper portion of the support rod exposes the top cover of the outer loop; the transition portion is located at a position of the shallow recess and is in intimate contact with the elastic piece shallow recesses of the elastic piece. In a preferred example, the transition portion is a sloped body. The elastic piece is clamped at the position of the transition portion, and the transition portion is a sloped body with a slope, this structure can make the elastic piece moderately release the elastic force, and the elastic piece can be clamped at a suitable position on the support rod, that is adaptive, so that the elastic piece can be prevented from being excessively pressed and causes the elasticity to be damaged, and at the same time, the scratch of the elastic piece on the surface of the support rod can be reduced.

In order to solve the third technical problem of the present application, the present application provides a ring, including: a ring body and a ring support located on the ring body, further including a top structure of the ring including a ring accessory, the ring accessory includes an outer loop and a spring piece; the elastic piece is placed in the outer loop; the outer loop includes a lateral loop and a top cover located above the lateral loop; the top cover has a hole for a ring head to pass through, the inner side of the top cover and the edge of the hole includes at least three deep recesses, and a shallow recess disposed between adjacent two deep recesses, wherein a distance from the deep recess to the center of the hole is greater than a distance from the shallow recess to the center of the hole; the elastic piece is an annular elastic piece including recesses corresponding to the deep recesses and the shallow recesses on the top cover, That is, the elastic piece deep recesses and the elastic piece shallow recesses, the elastic piece is an annulus with a wave shape, the elastic piece deep recesses are located at the bottom of the wave, and the elastic piece shallow recesses are located at the top of the wave.

The above ring head of the ring can be incompletely replaced, since the outer loop occupies a large area of the ring head, the overall decorative effect on the ring head is obvious, so it can be considered that the replacement of the outer loop can significantly change the overall decoration of the ring head of the ring, based on the above structure, the ring of the present application can provide a renewal of the ring head, and the replaced component can be firmly mounted on the ring head without falling off. Since the outer loop can provide a larger area, so various gemstone particles can be inlaid on the outer loop, the decorative style of the ring head is diversified, and the problem that the decorative area of the ring head is too small is solved.

Figure 1:
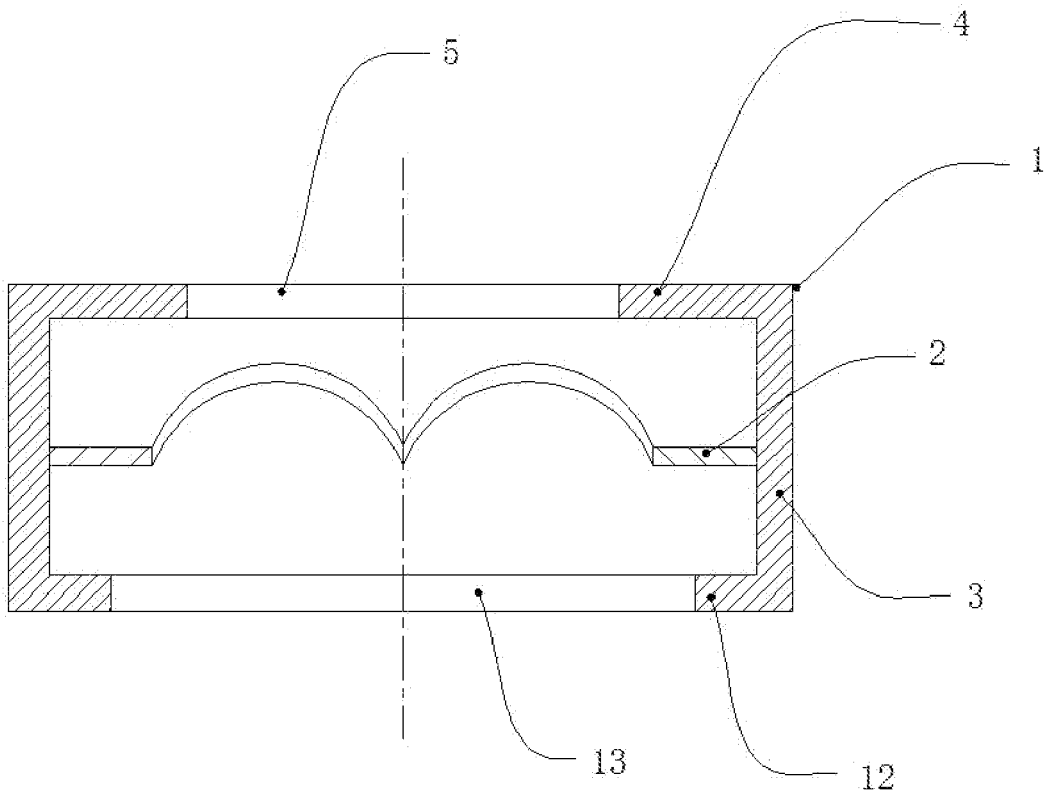
FIG. 1 is a principle view of the present application.
Figure 2:
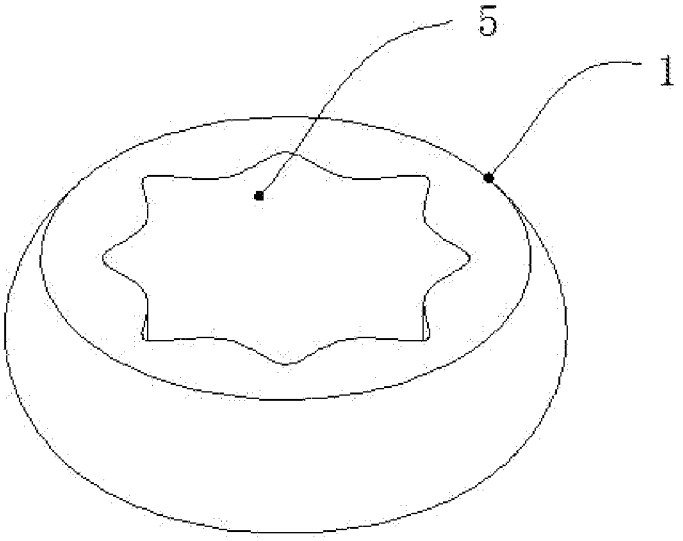
FIG. 2 is a perspective view of an outer loop of the present application in a embodiment.
Figure 3:
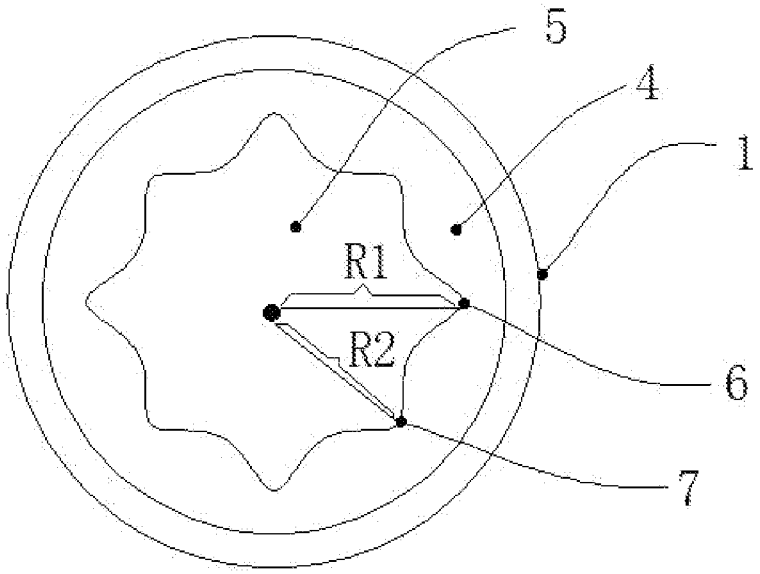
FIG. 3 is a top view of an outer loop.
Figure 4:
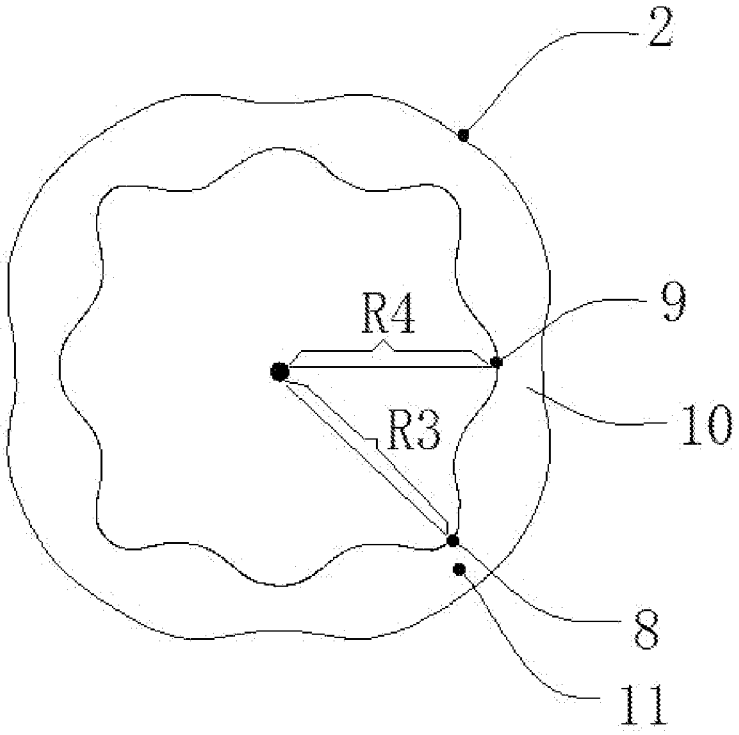
FIG. 4 is a top view of an elastic piece.
Figure 5:
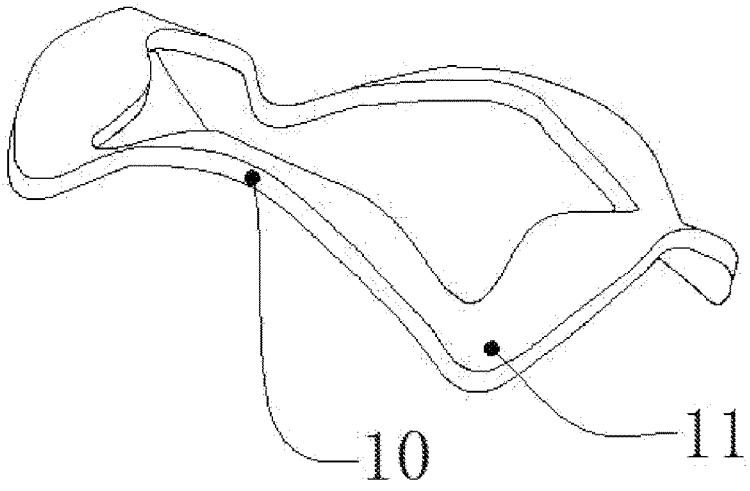
FIG. 5 is a perspective view of an elastic piece.
Figure 6:
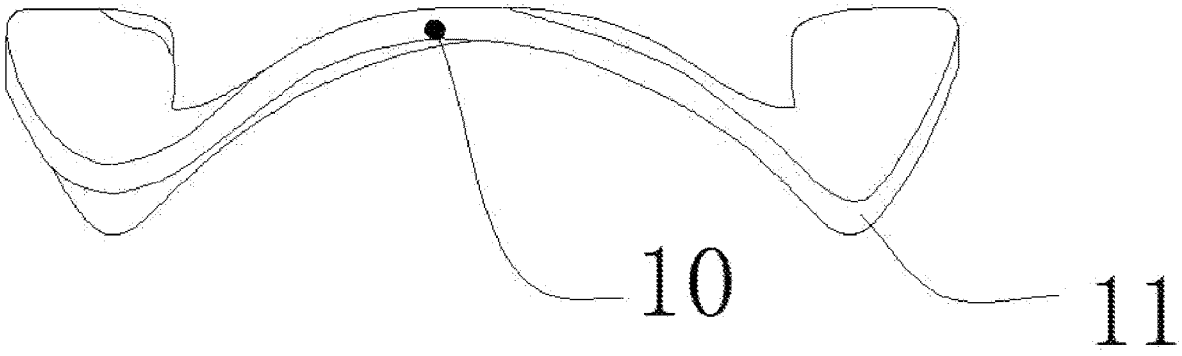
FIG. 6 is a side view of an elastic piece.

In the drawings, the reference numerals are listed and referred to as follows:

1 outer loop; 2 elastic piece; 3 lateral loop; 4 top cover; 5 hole; 6 deep recess; 7 shallow recess; 8 elastic piece deep recess; 9 elastic piece shallow recesses; 10 protrusion portion; 11 sunken portion; 12 bottom cover; 13 bottom opening; 14 ring support; 15 support rod; 16 distal end; 17 symmetry center of the ring support; 18 proximal end; 19 transition portion; 20 ring body.

DETAILED DESCRIPTION OF THE EMBODIMENTS

The present application will be further described in detail below in conjunction with the drawings and specific embodiments.

The present application provides a ring accessory, referring to FIGS. 1 to 6, the ring accessory includes an outer loop 1 and an elastic piece 2. FIG. 1 is a schematic cross-sectional view of the outer loop and the elastic piece. The elastic piece 2 is placed in the outer loop 1, and a part of the outer edge of the elastic piece is in contact with the outer loop, so that the elastic piece is clamped in the outer loop. The outer loop includes a lateral loop 3 and a top cover 4 above the lateral loop. The top cover 4 has a hole 5 for the ring head passing through. An inside of the top cover at an edge of the hole include at least three deep recesses.

The following embodiments are exemplified by four deep recesses, but the protection of the present application is not limited to the structure of four deep recesses. The top cover 4 has four deep recesses 6, and the hole of the top cover is a octagonal hole.

A shallow recess 7 is provided between two adjacent deep recesses, wherein a distance R1 from the deep recess to the center of the hole is greater than a distance R2 from the shallow recess to the center of the hole. That is, R1>R2.

The elastic piece 2 is an annular elastic piece, and includes recesses corresponding to the deep recesses and the shallow recesses on the top cover, the inner side of the top cover has four deep recesses, and four shallow recesses are located among the four deep recesses, Therefore, the elastic piece also includes four elastic piece deep recesses and four elastic piece shallow recesses. The elastic piece is an octagonal elastic piece. The deep recesses and shallow recesses on the top cover are evenly distributed on the top cover.

The elastic piece includes elastic piece deep recesses 8 and elastic piece shallow recesses 9, and the elastic piece is an annulus with a wave shape, which includes the convex portion 10 and the sunken portion 11. The elastic piece deep recesses 8 are located at the bottom of the wave, that is, at the sunken portion 11, the elastic piece shallow recesses 9 are located at the top of the wave, that is, at the middle of the convex portion 10.

A bottom cover 12 is also disposed under the lateral loop 3, and a bottom opening for the ring head passing through is disposed at the middle of the bottom cover 12. Since the outer loop is a metal ring, its volume is small and its strength is weak, so the arrangement of the bottom cover can increase the strength of the outer loop. In one embodiment, the sunken portion of the elastic piece can be supported at the bottom cover, which can be served as a support component for the elastic piece.

A distance R4 from the elastic piece shallow recess to the center of the hole is smaller than a distance from the shallow recess to the center of the hole. The elastic piece needs to apply force to the support rod in a radial direction. In a situation of the outer loop without elasticity, the ring diameter of the elastic piece is smaller than the hole diameter of the top cover, which is advantageous for the elastic piece to fasten the support rod, so that the outer loop is not easy to loosen. The function of the elastic piece is to press the support rod elastically to fix the support rod in the outer loop.

In a preferred embodiment, the outer loop 1 is circular and the elastic piece 2 is rounded quadrilateral. However, the shape of the outer loop is not limited to a circular shape, and may be various shapes such as a heart shape, a square shape, and the like, but since a structure of the deep recess and the shallow recess is required, the hole therein is generally regular and symmetrical shapes, and it has a symmetry center, that is, the center of the hole. The four deep recesses can be on a same circle, and the four shallow recesses can be on a same circle. Similarly for the elastic piece, the elastic piece deep recesses can be placed on a circle of the same radius, and the four elastic piece shallow recesses can be on the circle of the same radius.

The elastic piece 2 is a quadrangular wavy component, of which four corners are rounded. After being pressed by the support rods on the four sides of the quadrilateral, the elastic piece expands outward and the whole tends to be circular to ensure that the elastic piece has sufficient expansion space in the outer loop, which not only ensures the elastic force of the elastic piece, but also ensures the expansion space thereof, the elastic piece is non-circular before the force is applied, and its diameter is small, which is easier to fit into the outer loop, and the disassembly is quicker and more convenient. The wavy structure of the elastic piece makes it have greater elasticity, and the outer part of the elastic piece can press the inner wall of the outer loop, and the inner surrounding part can press the support rod and press it tightly, thereby fixing the outer loop on the ring support.

The outer loop of the present application needs to be matched with a corresponding ring support structure. Referring to the structure shown in FIGS. 7-9.

Figure 7:
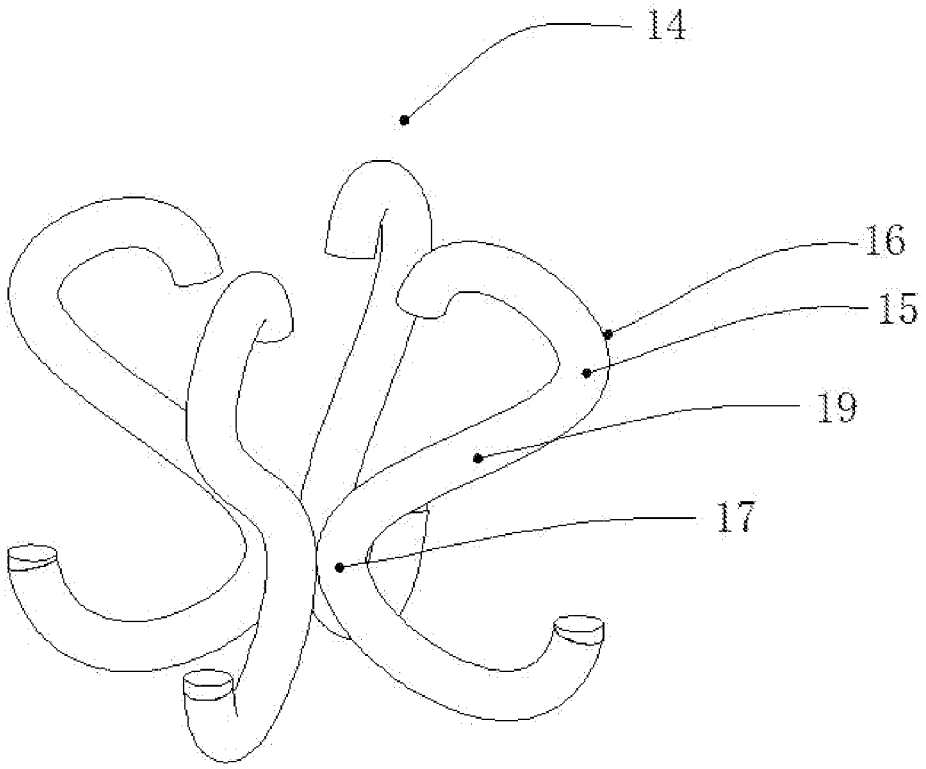
FIG. 7 is a structure view of a ring support.

The ring head is provided with a ring support 14, and the ring support 14 includes a support rod 15. FIG. 7 shows the ring support having four support rod structures. The support rod 15 includes a distal end 16 at the upper portion thereof, and a distance R5 from the distal end 16 to the symmetry center of the ring support is no greater than a distance R1 from the deep recess to the center of the hole. The distal end needs to pass through the deep recess, so R5 generally cannot be larger than R1, unless the support rod has a certain elasticity, and there is a reasonable range of fluctuation.

The support rod further includes a proximal end 18 at the lower portion thereof, a distance from the proximal end 18 to the symmetry center 17 of the ring support is smaller than a distance from the distal end, in this example, a distance from the proximal end 18 to the symmetry center 17 of the ring support may be zero, while a distance from the proximal end 18 to the symmetry center 17 is smaller than a distance R2 from the shallow recess to the center of the hole, and a transition portion 19 between the distal end and the proximal end of the support rod. The outer loop 1 is fixed to the ring support 14 and the upper portion of the support rod 15 protrudes from the top cover of the outer loop. The transition portion 19 is located at a shallow recess and is in close contact with the elastic piece shallow recess of the elastic piece, and the transition portion is a sloped body. The elastic piece is clamped at the position of the transition portion, and the transition portion 19 is an inclined body with a slope, this structure can make the elastic piece moderately release the elastic force, and the elastic piece can be clamped at a suitable position on the support rod, that is adaptive, so that the elastic piece can be prevented from being excessively pressed and causes the elasticity to be damaged, and at the same time, the scratch of the elastic piece on the surface of the support rod can be reduced.

Figure 11:
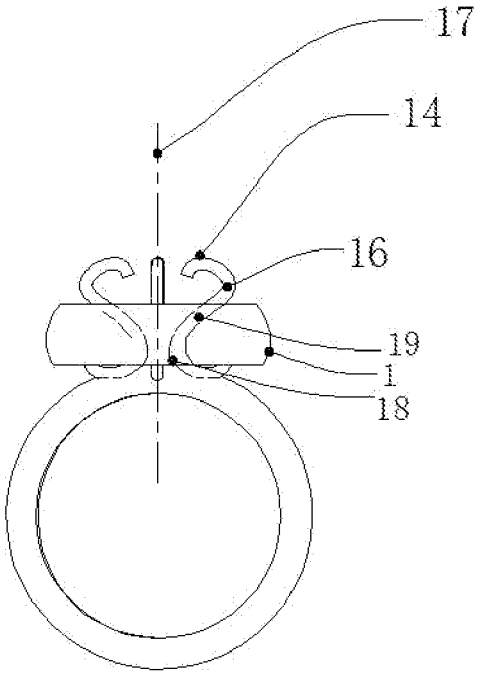
FIG. 11 is front effect view of a ring of the present application.
Figure 12:
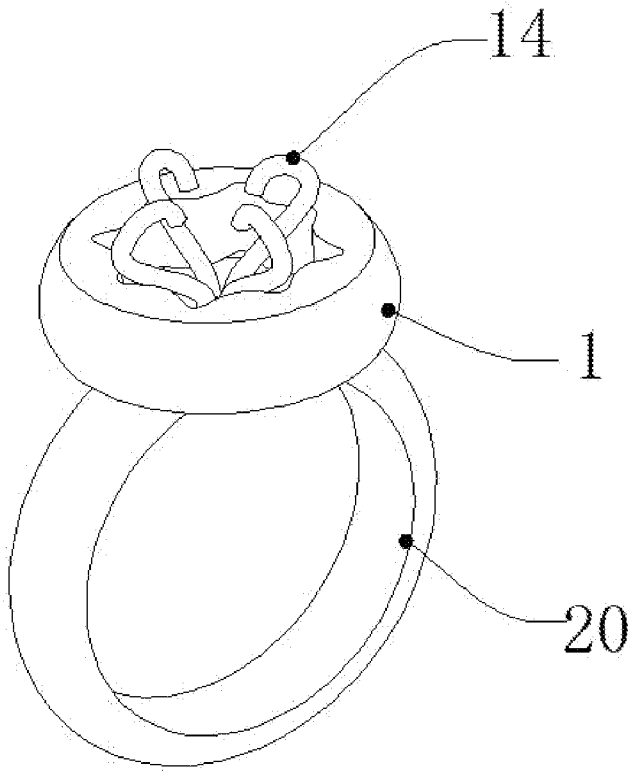
FIG. 12 is perspective effect view of a ring of the present application.

FIGS. 11 and 12 show the ring according to the present application, and a ring support 14 is disposed on the ring body 20.

The above ring head of the ring can be incompletely replaced, since the outer loop occupies a large area of the ring head, the overall decorative effect on the ring head is obvious, so it can be considered that the replacement of the outer loop can significantly change the overall decoration of the ring head of the ring, based on the above structure, the ring of the present application can provide a renewal of the ring head, and the replaced component can be firmly mounted on the ring head without falling off. Since the outer loop can provide a larger area, so various gemstone particles can be inlaid on the outer loop, the decorative style of the ring head is diversified, and the problem that the decorative area of the ring head is too small is solved.

Figure 8:
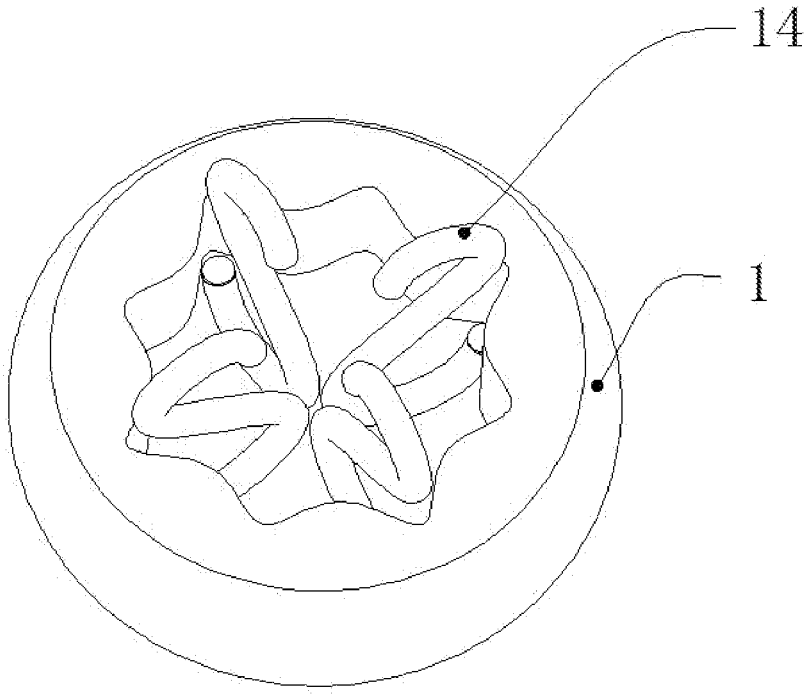
FIG. 8 is a structure view of a ring head.
Figure 9:
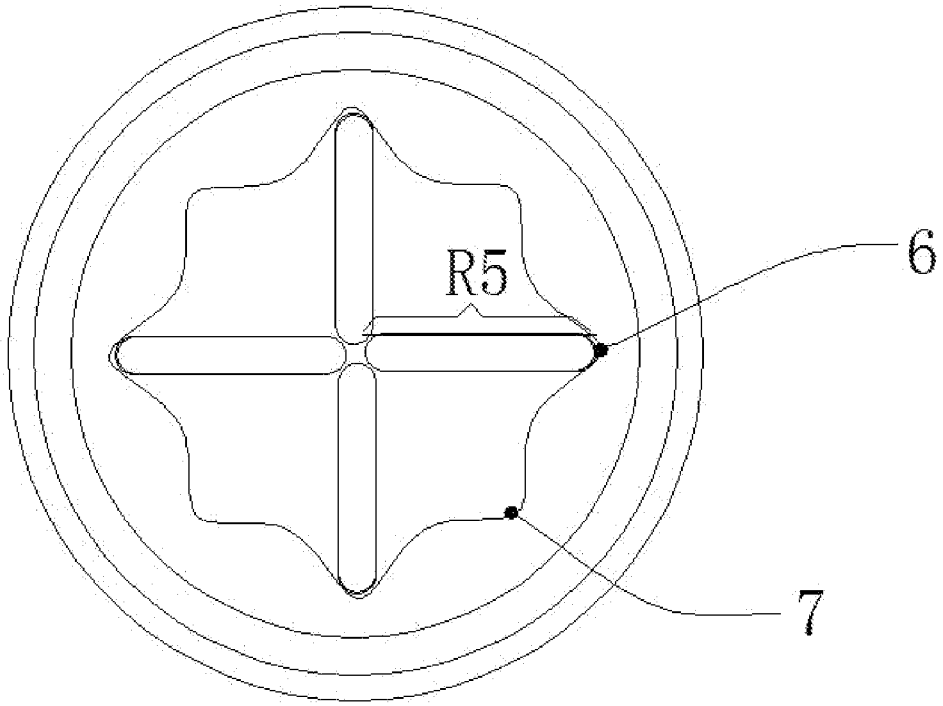
FIG. 9 is a schematic view when an outer loop is inset into the ring support.
Figure 10:
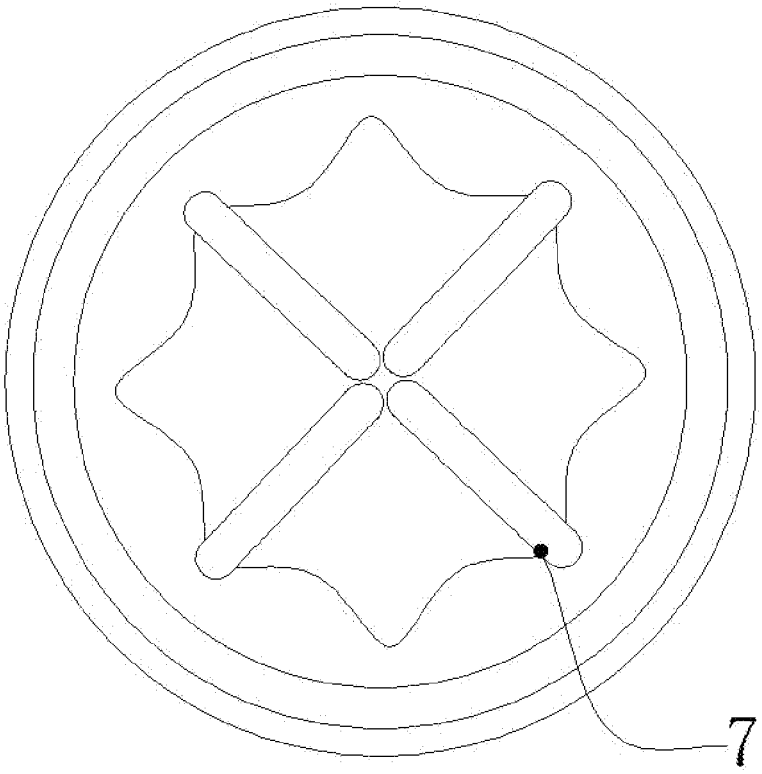
FIG. 10 is a schematic view when an outer loop is clamped at the ring support.

The above embodiment is based on a design scheme of four deep recesses and four shallow recesses, so an octagonal pattern is formed on the top cover, that is, four deep recesses and four shallow recesses. Referring to FIGS. 8-10, after the support rod of the ring support passes through the deep recess, it just rotates 45° into the shallow recess and is locked in the shallow recess by the elastic piece recess of the outer loop. In the actual design, diamonds or various gemstones can be installed and fixed in the ring support.

The above embodiments are merely preferred embodiments of the present application, and the scope of the present application is not limited thereto, and any insubstantial changes and substitutions made by those skilled in the art based on the present application belong to the scope of protection required in present application.

What is claimed is:

1. A ring accessory, wherein the ring accessory comprises: an outer loop and an elastic piece; the elastic piece is placed within the outer loop; the outer loop comprises a lateral loop and a top cover located above the lateral loop; the top cover has a hole configured for a ring head passing therethrough, an inner side of the top cover comprises at least three deep recesses at an edge of the hole, and a shallow recess is provided between every two adjacent deep recesses, wherein a distance from each deep recess to the center of the hole is greater than a distance from the shallow recess to a center of the hole; the elastic piece is annular and comprises recesses, and the recesses comprise elastic piece deep recesses and elastic piece shallow recesses respectively corresponding to the deep recesses and the shallow recesses of the top cover, wherein the elastic piece is an annulus with a wave shape, with the elastic piece deep recesses being located at a bottom of the wave and the elastic piece shallow recesses being located at a top of the wave.

2. The ring accessory of claim 1, wherein four deep recesses are provided on the inner side of the top cover, and four shallow recesses are respectively arranged between adjacent ones of the four deep recesses; the elastic piece also comprises four elastic piece deep recesses and four elastic piece shallow recesses.

3. The ring accessory of claim 2, wherein the outer loop is circular, and the elastic piece is a rounded quadrangle.

4. The ring accessory of claim 1, wherein the deep recesses and the shallow recesses of the top cover are evenly distributed on the top cover.

5. The ring accessory of claim 1, wherein a bottom cover is further disposed under the lateral loop, and a bottom opening is disposed in a middle of the bottom cover for a ring head pass therethrough.

6. The ring accessory of claim 1, wherein a distance from the elastic piece shallow recess to the center of the hole is smaller than a distance from the shallow recess to the center of the hole.

7. The ring accessory of claim 1, wherein a pendant is further disposed below the outer loop.

8. A ring head structure, comprising:

a ring accessory having: an outer loop and an elastic piece; the elastic piece is placed within the outer loop; the outer loop comprises a lateral loop and a top cover located above the lateral loop; the top cover has a hole configured for a ring head passing therethrough, an inner side of the top cover comprises at least three deep recesses at an edge of the hole, and a shallow recess is provided between every two adjacent deep recesses, wherein a distance from each deep recess to the center of the hole is greater than a distance from the shallow recess to the center of the hole; the elastic piece comprises elastic piece deep recesses and elastic piece shallow recesses respectively corresponding to the deep recesses and the shallow recesses of the top cover, wherein the elastic piece is an annulus with a wave shape, with the elastic piece deep recesses being located at a bottom of the wave and the elastic piece shallow recesses being located at a top of the wave; and a ring support;

wherein the ring support comprises a support rod; the support rod comprises a distal end located at an upper portion thereof, and a distance from the distal end to a symmetry center of the ring support is no greater than a distance from the deep recess to the center of the hole.

9. The ring head structure of claim 8, wherein the support rod further comprises a proximal end located at a lower portion thereof, a distance from the proximal end to the symmetry center of the ring support is smaller than a distance from the distal end to the symmetry center of the ring support, and a distance from the proximal end to the symmetry center of the ring support is no greater than a distance from a shallow recess to a center of the hole, with a transition portion arranged between the distal end and the proximal end of the support rod; the outer loop is held onto the ring support, with the top cover of the outer loop being exposed at the upper portion of the support rod; the transition portion is located at a position of the shallow recess and is in close contact with the elastic piece shallow recesses of the elastic piece.

10. A ring, comprising: a ring body and a ring support located at the ring body, wherein the ring further comprises a ring head including a ring accessory having: an outer loop and an elastic piece; the elastic piece is placed within the outer loop; the outer loop comprises a lateral loop and a top cover located above the lateral loop; the top cover has a hole configured for a ring head passing therethrough, an inner side of the top cover comprises at least three deep recesses at an edge of the hole, and a shallow recess is provided between every two adjacent deep recesses, wherein a distance from each deep recess to a center of the hole is greater than a distance from the shallow recess to the center of the hole; the elastic piece comprises elastic piece deep recesses and elastic piece shallow recesses respectively corresponding to the deep recesses and the shallow recesses of the top cover, wherein the elastic piece is an annulus with a wave shape, with the elastic piece deep recesses being located at a bottom of the wave and the elastic piece shallow recesses being located at a top of the wave; and wherein the ring support comprises a support rod; the support rod comprises a distal end located at an upper portion thereof, and a distance from the distal end to the symmetry center of the ring support is no greater than a distance from the deep recess to the center of the hole; wherein the support rod further comprises a proximal end located at a lower portion thereof, a distance from the proximal end to the symmetry center of the ring support is smaller than a distance from the distal end to the symmetry center of the ring support, and a distance from the proximal end to the symmetry center of the ring support is no greater than a distance from a shallow recess to the center of the hole, with a transition portion arranged between the distal end and the proximal end of the support rod; the outer loop is held onto the ring support, with the top cover of the outer loop being exposed at the upper portion of the support rod; the transition portion is located at a position of the shallow recess and is in close contact with the elastic piece shallow recesses of the elastic piece.

* * * * *